US007690952B2

(12) United States Patent
Koellmann et al.

(10) Patent No.: US 7,690,952 B2
(45) Date of Patent: Apr. 6, 2010

(54) CONNECTING MODULE

(75) Inventors: Hans-Josef Koellmann, Minden (DE); Konrad Stromiedel, Wolkramshausen (DE); Lars Binner, Melle (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 12/330,399

(22) Filed: Dec. 8, 2008

(65) Prior Publication Data

US 2009/0149074 A1 Jun. 11, 2009

(30) Foreign Application Priority Data

Dec. 10, 2007 (DE) ..... 10 2007 059 640

(51) Int. Cl.
*H01R 9/26* (2006.01)

(52) U.S. Cl. ..... 439/716

(58) Field of Classification Search ..... 439/716, 439/709, 715, 922

See application file for complete search history.

(56) References Cited

U.S. PATENT DOCUMENTS

| | | | | |
|---|---|---|---|---|
| 4,956,747 | A * | 9/1990 | Beer et al. | 361/728 |
| 5,588,881 | A * | 12/1996 | Eggert et al. | 439/709 |
| 5,610,493 | A * | 3/1997 | Wieloch | 318/801 |
| 5,629,831 | A * | 5/1997 | Eggert et al. | 361/624 |
| 6,280,259 | B1 * | 8/2001 | Stollburges | 439/715 |
| 6,392,319 | B1 * | 5/2002 | Zebermann et al. | 307/147 |
| 6,411,500 | B1 * | 6/2002 | Kaaden et al. | 361/614 |
| 6,452,785 | B1 * | 9/2002 | Kaaden et al. | 361/622 |
| 7,192,316 | B1 * | 3/2007 | Pollmann | 439/716 |
| 2008/0261459 | A1 * | 10/2008 | Choi | 439/709 |

FOREIGN PATENT DOCUMENTS

| | | |
|---|---|---|
| DE | 295023473 | 2/1995 |
| DE | 10116797 A1 | 4/2001 |
| DE | 10213854 B4 | 3/2002 |
| WO | WO03/077370 A1 | 9/2003 |

* cited by examiner

*Primary Examiner*—T C Patel
*Assistant Examiner*—Vladimir Imas
(74) *Attorney, Agent, or Firm*—Whitham Curtis Christofferson & Cook, PC

(57) ABSTRACT

A connecting module (1) having a insulating-material housing (2), at least one conductor connecting terminal (7) which is fitted into the insulating-material housing (2) and is accessible via an associated conductor insertion opening in the insulating-material housing (2) in order to hold an electrical conductor, and having at least one busbar bar (3), which is electrically connected to one or more associated conductor connecting terminals (7), is in the form of a round bar and is laid in associated channels (4) in the insulating-material housing (2) is described. At least one busbar bar (3) is angled and has a first connecting section (5, 9) which contains a free end and extends at an angle to a direction section (8) which extends to the connecting section (5, 9). The connecting section (5, 9) is inserted into a connecting opening (6) in the associated conductor connecting terminal (7) such that the extent direction is located essentially transversely with respect to the extent direction of the connecting opening (6) and parallel to the perpendicular to the plane which is covered by the connecting opening (6), and the direction section (8) is aligned in a desired extent direction in an associated channel (4) by suitable rotational alignment of the connecting section (5, 9) about its axis.

13 Claims, 4 Drawing Sheets

CONNECTING MODULE

BACKGROUND OF THE INVENTION

1. Field of the Invention

The invention relates to a connecting module having an insulating-material housing, at least one conductor connecting terminal which is fitted into the insulating-material housing and is accessible via an associated conductor insertion opening in the insulating-material housing in order to hold an electrical conductor, and having at least one busbar bar, which is electrically connected to one or more associated conductor connecting terminals, is in the form of a round bar and is laid in associated channels in the insulating-material housing.

2. Description of Related Art

Connecting modules such as these are known from DE 295 02 347 U1. They are produced, for example, in the form of jumpering terminals with a plurality of levels which, in each level, have in each case one connecting body, in each case on the panel side and on the jumpering side, with a clamping point for the connection of an external electrical conductor. The connecting bodies are connected by means of internal electrical conductors, so-called busbar bars, which are held in a conductor bed, which runs in the form of a channel, in the insulating-material housing of the jumpering terminal.

The connecting modules are normally clipped onto mounting rails, and a plurality of them form a conductor connecting arrangement.

The connecting modules can also be used for other purposes, for example as relay base modules etc.

It is also known for such connecting modules to be designed with busbar bars which are manufactured as a continuous stamped and bent part integrally with the conductor connecting terminals. These integral busbar bars, which are provided with the conductor connecting terminals, must be matched to the conductor beds or conductor channels in the insulating-material housing such that they can be fitted without any problems, taking into account the manufacturing tolerances.

It is also known for the busbar bars to be manufactured separately as sheet-metal parts and for the conductor connecting terminals to be connected to the conductor connecting terminals after the flat and curved busbars have been inserted into the insulating-material housing.

BRIEF SUMMARY OF THE INVENTION

The object of the present invention is therefore to provide an improved connecting module in which busbar bars and associated conductor connecting terminals can be fitted in the insulating-material housing easily, at low cost and flexibly.

The object is achieved by the connecting module of the type mentioned initially in that at least one of the busbar bars is angled and has a first connecting section which contains a free end and extends at an angle to a direction section which extends to the connecting section, and in that the connecting section is inserted into a connecting opening in the associated conductor connecting terminal such that the extent direction is located essentially transversely with respect to the extent direction of the connecting opening and parallel to the perpendicular to the plane which is covered by the connecting opening, and the direction section is aligned in a desired extent direction in an associated channel by suitable rotational alignment of the connecting section about its axis.

In contrast to the prior art, in particular to the jumpering terminal that is known from DE 295 02 374 U1, it is thus proposed that the busbar bars, which are in the form of round bars, be angled and that the angled connecting section be inserted (at right angles) into the associated conductor connecting terminal. The angling in conjunction with the round cross section of the busbar means that the direction section, which originates from the connecting section at an angle, can be pivoted on a plane (e.g. horizontal plane) which is defined by the extent direction of the connecting section and the angle that is formed. This allows tolerance compensation when the round busbar bar is inserted into an associated (busbar bar) channel in the insulating-material housing. Considerably simplified fitting is therefore possible when the round busbar bars are fitted onto the conductor connecting terminals, which have been inserted into the insulating-material housing, or vice versa.

The use of angled round busbar bars also has the advantage that the busbars can be matched at low cost and easily to virtually any desired three-dimensional route of a busbar bar. In contrast to sheet-metal busbars, round busbar bars can be bent in a simple manner in virtually any desired direction. Furthermore, there is no scrap, as when sheet-metal busbars are stamped. This makes it possible to considerably reduce the investment and material costs, as well as the assembly costs.

In one preferred embodiment, both free ends of a busbar bar each have a connecting section which is connected to a connecting terminal. The connecting sections are in this case aligned approximately parallel thereto at the mutually opposite ends. This makes it possible to match the at least one direction section, which is adjacent to the two connecting sections, on a predetermined plane to the busbar holding chamber in the insulating-material housing. The expression approximately parallel means a discrepancy of up to ±5°.

The direction sections preferably extend transversely with respect to connecting sections which are adjacent to them, that is to say the direction sections are at right angles to the connecting sections. This clearly defines the pivoting plane of the direction sections. If, for example, the connecting section extends vertically in the insulating-material housing, this allows the direction section to be fitted in a horizontal plane of the busbar holding channel, which in this case is aligned horizontally.

As in the case of a jumpering terminal by way of example, it is preferable to provide a plurality of busbar holding channels, for holding direction sections of the busbar bars, in the insulating-material housing. The busbar holding channels in this case extend in horizontal planes which are separated therefrom in parallel, to which channels, which each originate from the horizontal channels, are connected in order to hold connecting sections or further direction sections.

It is furthermore advantageous if at least some of the conductor connecting terminals which are held in the insulating-material housing have connecting openings on both sides in order to hold busbar bars. It is thus possible to use universal conductor connecting terminals which have connecting openings for holding the round busbar bars independently of their installation orientation, on a fitting side of the insulating-material housing. The arrangement of connecting openings on both sides of the conductor connecting terminals furthermore has the advantage that this allows more complex wiring of conductor connecting terminals with the aid of a plurality of round busbar bars. The connecting openings in the conductor connecting terminals may, for example, be in the form of bays, which are open on one side on a side edge of at least one contact area which is in the form of a plate, into which a connecting section of a busbar bar can be inserted and attached. The connecting openings may, however, also be formed from troughs which are each formed from the bottom part and two side parts, which are at a distance from one another and are aligned parallel to one another, of a folded-around contact area. This results in two connecting bays which are aligned with one another. This increases the current carrying capability and the reliability of an electrical contact of the conductor connecting terminal with the round busbar bar.

In a folded-around contact area of a conductor connecting terminal such as this, it is also advantageous for ends of the side parts of the contact areas to have ends which face one another. This allows a contact tulip to be provided on the conductor connecting terminal. A conductor which is inserted into the contact tulip then makes contact with the mutually facing ends of the side parts of the contact areas.

In the case of a contact tulip such as this, the side parts preferably have folds with sections which face one another, in order to form a conductor plug contact. In one preferred embodiment, it is advantageous for busbar bars to have sections which are curved in a U-shape, whose parallel round bar sections are aligned with associated plug contact openings in an insulating-material housing and form plug contacts for the plug contact pins which can be inserted into the plug contact openings. Further clamping points are thus formed from the round bar sections by bending around in a U-shape, as a result of which plug contact pins make contact with the parallel round bar sections through openings in the insulating-material housing. The parallel round bar sections are formed by the U-shaped bends, in order to form plug sockets for example for connecting pins of a display element or of a relay, which is placed on the insulating-material housing. The plug socket may be rigid in order to hold sprung connecting pins, or may be sprung in order to hold rigid connecting pins. Connecting sections of busbar bars may be connected to associated connecting openings in the associated conductor connecting terminal by soldering, crimping, welding or insertion with an interference fit. This ensures a good electrical contact. The connecting section and the connecting opening in the associated conductor connecting terminal should be connected only after installation of the conductor connecting terminal and busbar bar, and alignment of the busbar bar.

The connecting module may be passive and may connect to one another only electrical conductors which are clamped onto the conductor connecting terminals, in order in this way to allow electrical power or data to be transmitted. However, it is particularly advantageous for the connecting module to contain active or passive electronic and/or electromechanical components, which are electrically conductively connected to at least one of the busbar bars, and are fitted in the insulating-material housing.

In a further preferred embodiment type the connecting module may, for example, form a relay base.

BRIEF DESCRIPTION OF THE DRAWINGS

The invention will be explained in more detail in the following text with reference to exemplary embodiments and using the attached drawings, in which.

DETAIL DESCRIPTION OF THE INVENTION

Figure 1:
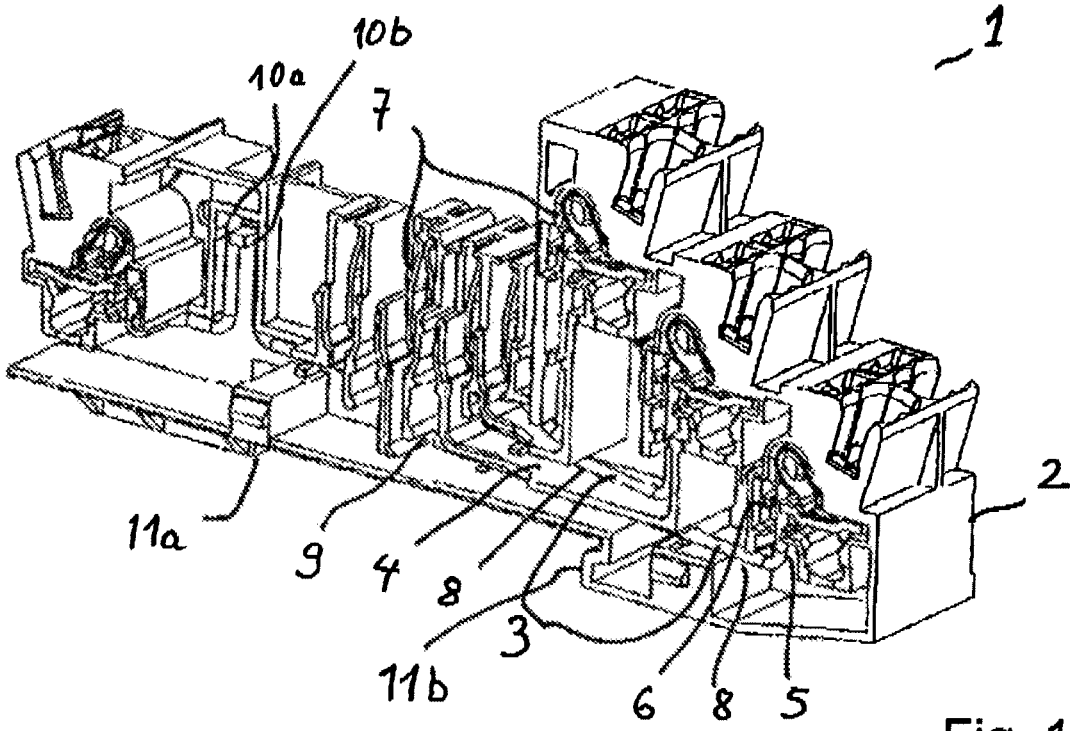
FIG. 1 shows a perspective view of a connecting module in the form of a relay base.

FIG. 1 shows a perspective view of a connecting module 1 in the form of a relay base. The connecting module 1 has an insulating-material housing 2, which may be formed from one or more parts. Busbar bars 3 in the form of round bars are fitted into the insulating-material housing 2, and are fitted in channels 4 in the insulating-material housing 2. The busbar bars 3 are angled and have connecting sections 5 which can be inserted into a connecting opening 6 in an associated conductor connecting terminal 7. A direction section 8 as well as direction and connecting sections 8, 5, 9, which originate therefrom and may also be angled, extend at an angle to a connecting section 5.

As can be seen, the connecting sections 5 are inserted into the connecting openings 6 in the associated connecting terminals 7 such that the direction sections 8 can be moved on a defined plane in the associated channel 4 by rotation of the connecting section 5 about its longitudinal axis. This allows tolerance compensation and creates considerable design degrees of freedom for the laying of the busbar bars 3 in the insulating-material housing 2.

A further connecting section 9 can be provided at the opposite end of a busbar 3 to the connecting section 5, and is fitted into a connecting opening 6 in an associated conductor connecting terminal 7.

It is also feasible for the curved busbar bars 3 to have at least one area in which a direction section 8 is curved in a U-shape, as a result of which two round bar sections 10*a*, 10*b* run parallel to one another, at a relatively short distance from one another. This creates a clamping point for holding plug contact pins which are aligned through a plug contact opening, which is aligned with the clamping point, in the insulating-material housing 2. The plug contact pins may, for example, be connecting pins of a relay which can be fitted to the connecting module 1.

The connecting module 1 may be prepared in a manner known per se with suitable clamping elements 11*a*, 11*b* for fitting to a mounting rail.

Figure 2:
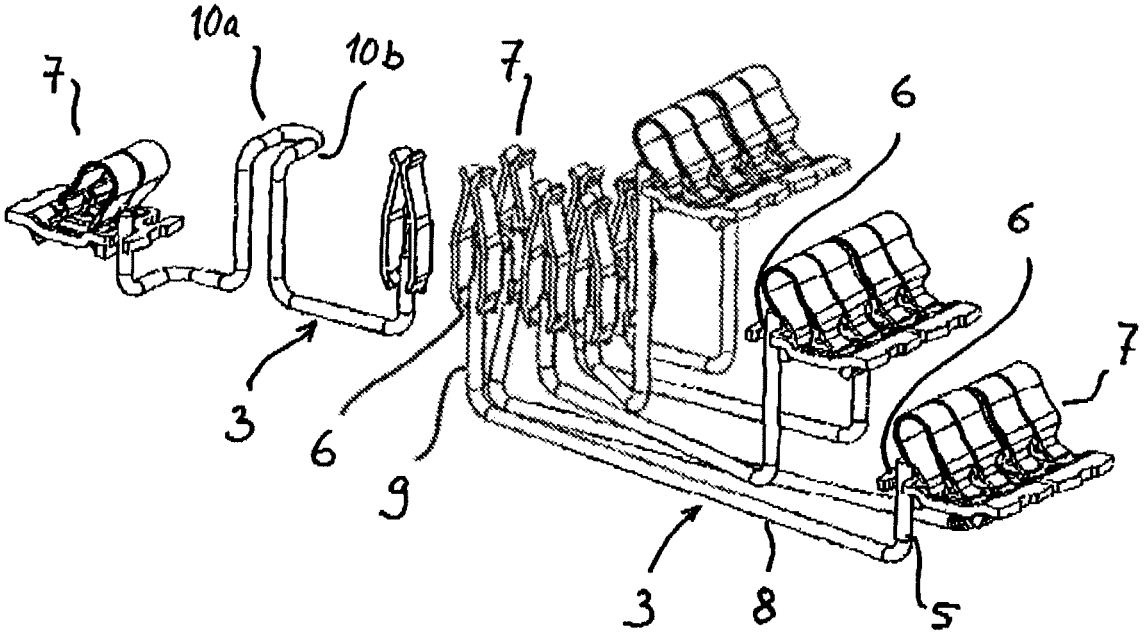
FIG. 2 shows a perspective illustration of the connecting module from FIG. 1 without a surrounding insulating-material housing.

FIG. 2 shows the perspective view from FIG. 1 in an exploded form, without the insulating-material housing 2. This clearly shows that the busbar bars 3 are angled and are inserted with the vertical connecting sections 5, 9 into connecting openings 6 in the associated conductor connecting terminals 7. In contrast to round busbar bars 3 which are not angled, splitting the busbar bars 3 into connecting sections 5, 9 and direction sections 8 which originate transversely therefrom allows tolerance compensation during insertion of the busbar 3 into the associated channels 4 in an insulating-material housing 2, and allows the busbar bars 3 to be laid in three-dimensional space by matched bending of the busbar bar 3. The matching to the desired profile of the busbar 3 in the associated channel 4 is carried out during insertion of the busbar 3 into the associated connecting openings 6.

A further degree of freedom is achieved by torsion, which is permissible to a certain extent, of the connecting sections 5, 9 about their longitudinal axis, and the flexibility of the angling between the connecting section 5, 9 and the adjacent direction section 8.

The connecting section 5, 9 and the associated connecting opening 6 in the conductor connecting terminal 7 are mechanically and electrically conductively connected for example by soldering, crimping, welding or the connecting opening being in the form of an interference fit for the connecting section 5, 9.

The connecting section 5, 9 and the associated connecting opening 6 are preferably firmly connected after a busbar bar 3 has been inserted into the connecting opening 6 of the conductor connecting terminals 7, which have already been inserted into an insulating-material housing 2. During insertion of the busbar bar 3 into the connecting openings 6, the busbar bar 3 can be aligned in the channels 4 in a simple manner.

Figure 3:
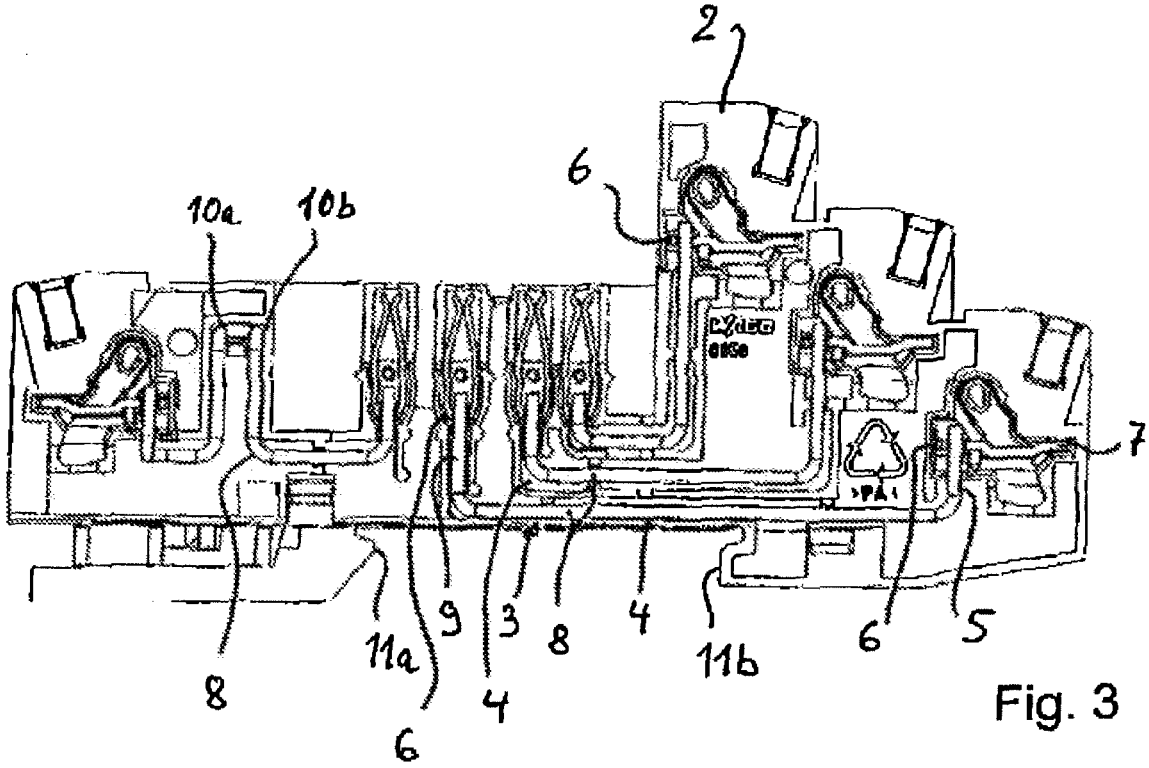
FIG. 3 shows a side view of the connecting module from FIG. 1.

FIG. 3 shows a side view of the connecting module 1 from FIGS. 1 and 2. The illustration clearly shows the angled form of the busbar bars 3, which are in the form of round bars. This shows in particular that the connecting sections 5, 9 extend transversely with respect to a direction section which is adjacent thereto and that the connecting section 5, 9 is inserted into a connecting opening 6 in the associated conductor connecting terminal 7 such that the extent direction is located transversely with respect to the extent direction of the connecting opening 6 and parallel to the perpendicular to the plane which is covered by the connecting opening 6. The direction section 8 is in this case aligned in a desired extent in an associated channel 4 in the insulating-material housing 2 by suitable rotational alignment of the connecting section 5 about its axis. The extent direction is indicated in the perspective illustration in FIGS. 1 and 2.

Figure 4:
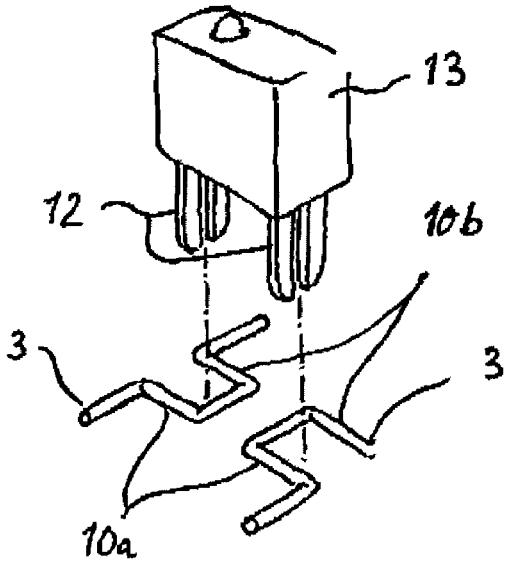
FIG. 4 shows a sketch of a component which can be fitted with contact pins to U-shaped conductor loops.

FIG. 4 shows a detail of the busbar bars 3, which are curved in a U-shape in a clamping point area and each have two round bar sections 10*a*, 10*b* which are at a distance from one another and run parallel to one another. The distance between the parallel round bar sections 10*a*, 10*b* is chosen such that the round bar sections 10*a*, 10*b* form a clamping point for plug contact pins 12 of a component. The plug contact pins 12 may, for example, be formed from sprung lugs, as is sketched in FIG. 4. The sprung lugs are in this case formed from a metal contact sheet which is slotted at least in places. The component 13 may be an electronic or electromechanical component, such as a display element.

Figure 5:
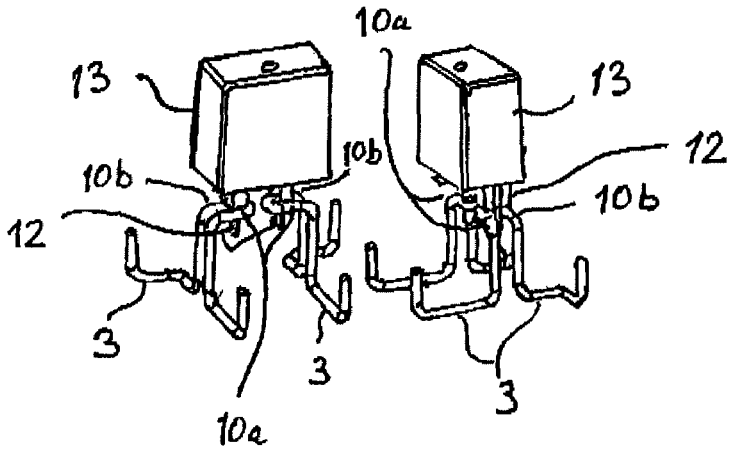
FIG. 5 shows a perspective view of the component fitted to U-shaped conductor loops.

FIG. 5 shows the component 13 from FIG. 4 in the inserted state with clamping points formed with the aid of the parallel round bar sections 10*a*, 10*b*. The plug contact openings, which are aligned with the clamping points, in the insulating-material housing (not illustrated) allow insertion of the plug contact pins 12.

Figure 6:
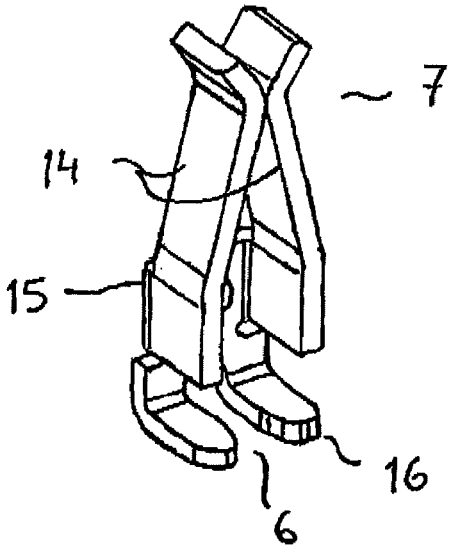
FIG. 6 shows a perspective illustration of a contact tulip as a conductor connecting terminal.

FIG. 6 shows one embodiment of a conductor connecting terminal 7 which is in the form of a contact tulip and has two contact lugs 14 (side parts) which are at a distance from one another, are aligned parallel to one another, and are partially bent away from one another. The contact lugs 14 are connected to one another by a lateral web 15 which merges into a base part 16 which originates transversely therefrom. A bay or trough is incorporated in the base part 16 in order to form a connecting opening 6, which is intended to hold a connecting section 5, 9 of a round busbar bar 3.

Figure 7:
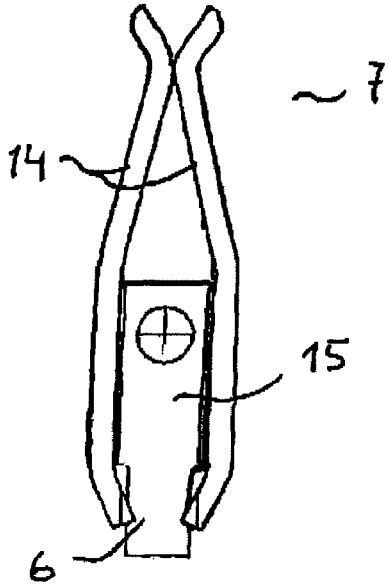
FIG. 7 shows a sketch of another embodiment of a contact tulip as a conductor connecting terminal.

FIG. 7 shows another embodiment of a conductor connecting terminal 7, which is likewise in the form of a contact tulip. In this embodiment, the contact lugs 14 (side parts) can be seen, which form a conductor plug contact with the aid of folding, with mutually facing sections. The contact lugs 14 are designed to be sprung for this purpose, as a result of which a conductor which is inserted into the contact area in the upper end, at which the mutually facing contact lugs 14 touch in the illustrated rest position, has an electrically conductive contact made with it.

In the lower area of the contact lugs 14 which are held together by a lateral web 15, the ends of the contact lugs 14 are bent towards one another, in order to form a connecting opening 6 for holding a connecting section 5, 9 of a round busbar bar 3.

When the round busbar bar 3 is being inserted into the connecting opening 6, and possibly also in the inserted state, the round busbar bar 3 can be rotated about the longitudinal axis of the connecting section 5, that is to say about the vertical axis in the illustrated alignment. A direction section 8, which originates at an angle from the connecting section 5, of the busbar bar 3 can then be moved on a plane which is defined by the angle between the direction section 8 and the adjacent connecting section 5 and the extent direction of the connecting section 5.

Figure 8:
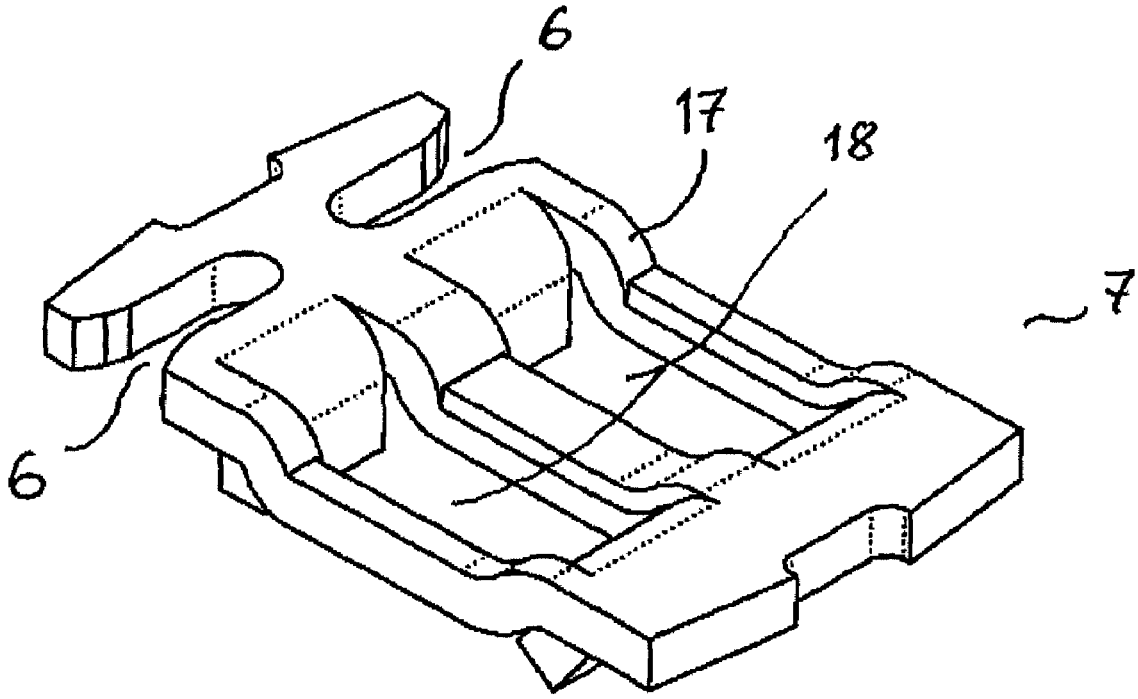
FIG. 8 shows a sketch of a double conductor connecting terminal with connecting openings on both sides for holding connecting sections of a round busbar bar.

FIG. 8 shows a perspective view of another embodiment of a conductor connecting terminal 7, of which only one busbar piece 17 is shown. Contact springs, which are not illustrated, are inserted into the openings 18 which are formed in the busbar piece 17, with the aid of which contact springs an electrical conductor can be clamped onto the conductor connecting terminal 7. This is adequately known in its own right and requires no further explanation.

Two connecting openings 6, which point in opposite directions, are incorporated opposite one another in the busbar piece 17 and are formed from corresponding bays with a U-shape in plan view, with a widening entry area. The widened entry area on the respective outer edge of the busbar piece 17 makes it easier to insert a round busbar bar 3 into the connecting openings 6. The formation of connecting openings 6 on both sides of the conductor connecting terminal 7 means that the conductor connecting terminal 7 can be used universally, and round busbar bars 3 can be inserted into an accessible connecting opening 6, independently of the insertion direction of the conductor connecting terminal 7.

A slight projection is incorporated in the connecting openings, which prevents the round busbar bars 3 from sliding out when subject to extreme loads.

Furthermore, the arrangement of connecting openings 6 on both sides offers the possibility of connecting one or two busbar bars 3 to one conductor connecting terminal 7. With an appropriate configuration, two or more busbar bars 3 can also be held in one connecting opening 6.

Figure 9:
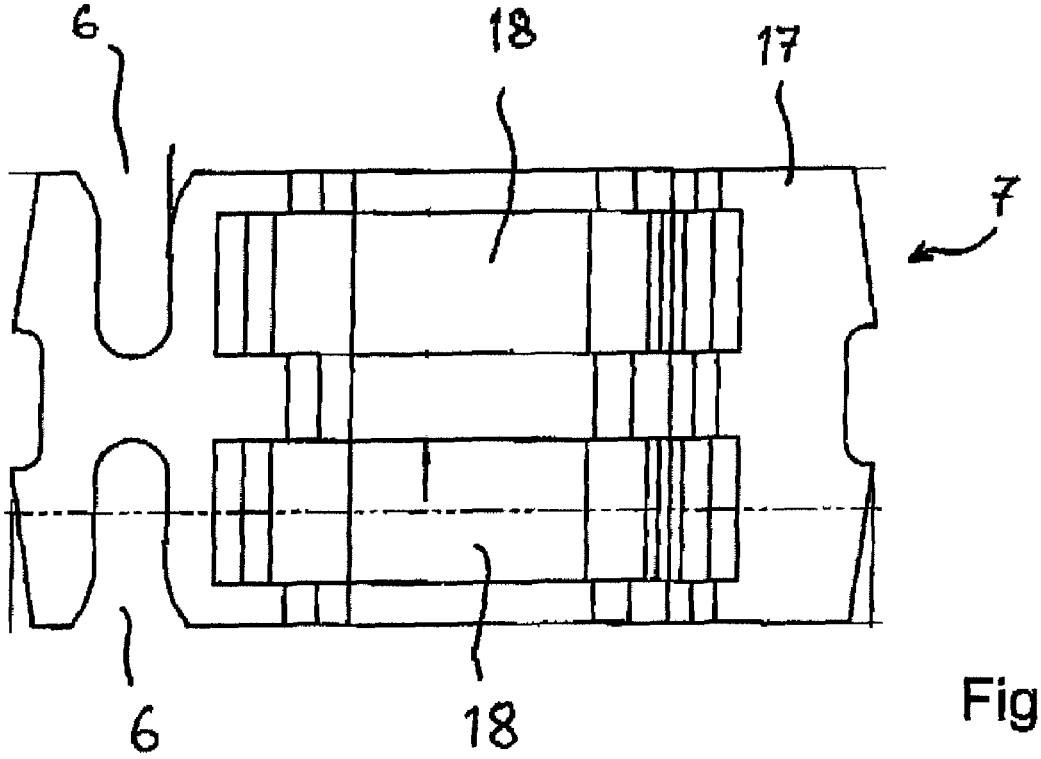
FIG. 9 shows a plan view of the conductor connecting terminal from FIG. 8.

FIG. 9 shows a plan view of the conductor connecting terminal 7 from FIG. 8. This clearly shows the U-shaped bays, which point away from one another, with a broadening entry on the side edges, in order to form the connecting opening 6.

The invention claimed is:

1. Connecting module, comprising:

an insulating-material housing;

at least one conductor connecting terminal comprising a spring clamp and a current conductor bar section, wherein the at least one conductor connecting terminal is fitted into the insulating-material housing and is accessible via an associated conductor insertion opening in the insulating-material housing in order to hold an electrical conductor; and at least one busbar bar electrically connected to one or more associated conductor connecting terminals of said at least one conductor connecting terminal, wherein the at least one busbar bar is in the form of a round bar and is laid in associated channels in the insulating-material housing, wherein at least one of the busbar bars is angled and has a connecting section comprising a free end and extends at an angle to a direction section extending to the connecting section, and wherein the connecting section is inserted into a connecting opening provided in the current conductor bar section of an associated conductor connecting terminal such that the extent direction is located essentially transversely with respect to the extent direction of the connecting opening and perpendicular to the plane which is covered by the connecting opening, and the direction section is aligned in a desired extent direction in an associated channel by suitable rotational alignment of the connecting section about its axis.

2. Connecting module according to claim 1, wherein both free ends of a busbar bar each have a connecting section which is connected to a conductor connecting terminal, with the connecting sections being aligned approximately parallel to one another.

3. Connecting module according to claim 1, wherein the direction sections extend transversely with respect to connecting sections which are adjacent to them.

4. Connecting module according to claim 1, wherein the insulating-material housing has a plurality of channels for holding direction sections of the busbar bars, wherein the plurality of channels extend on horizontal planes separated from one another in parallel, wherein the direction sections of the busbar bars originate transversely from the horizontal channels, and wherein the busbar bars are connected to the plurality of channels in order to hold connecting sections or direction sections of the busbar bars.

5. Connecting module according to claim 1, wherein conductor connecting terminals have connecting openings on both sides in order to hold busbar bars.

6. Connecting module according to claim 1, wherein connecting openings in conductor connecting terminals are in the form of bays, which are open on one side on a side edge of at least one contact area which is in the form of a plate, for insertion and attachment of a connecting section of a busbar bar.

7. Connecting module according to claim 1, wherein connecting openings in conductor connecting terminals are formed from troughs which are each formed from a bottom part and two side parts, which are at a distance from one another and are aligned parallel to one another, of a folded-around contact area.

8. Connecting module according to claim 7, wherein ends of the side parts of the contact areas have ends which face one another.

9. Connecting module according to claim 7, wherein the side parts have folds with sections which face one another, in order to form a conductor plug contact.

10. Connecting module according to claim 1, wherein the busbar bars have sections which are curved in a U-shape, wherein the busbar bars have parallel round bar sections that are aligned with associated plug contact openings in an insulating-material housing, and wherein the parallel round bar sections form plug contacts for plug contact pins which can be inserted into the plug contact openings.

11. Connecting module according to claim 1, wherein the connecting sections of the busbar bars are soldered, crimped, welded or inserted with an interference fit into the associated connecting openings.

12. Connecting module according to claim 1, wherein at least one of the busbar bars is connected to at least one electronic and/or electromechanical component which is fitted in the insulating-material housing.

13. Connecting module according to claim 1, wherein the connecting module forms a relay base.

* * * * *